US008100062B1

(12) United States Patent
Anghel

(10) Patent No.: US 8,100,062 B1
(45) Date of Patent: Jan. 24, 2012

(54) EXPANDABLE TABLE

(76) Inventor: Maria-Lucia Anghel, Oceanside, NY (US)

( * ) Notice: Subject to any disclaimer, the term of this patent is extended or adjusted under 35 U.S.C. 154(b) by 581 days.

(21) Appl. No.: 12/353,156

(22) Filed: Jan. 13, 2009

(51) Int. Cl.
*A47B 1/04* (2006.01)

(52) U.S. Cl. ..... 108/69

(58) Field of Classification Search ..... 108/69, 108/71–73, 76, 65, 150; 312/246, 281, 282
See application file for complete search history.

(56) References Cited

U.S. PATENT DOCUMENTS

| | | | | | |
|---|---|---|---|---|---|
| 7,789 | A | * | 11/1850 | Shoenberger | 108/93 |
| 831,797 | A | * | 9/1906 | Miller | 108/93 |
| 1,192,746 | A | * | 7/1916 | Brown | 108/93 |
| 1,429,969 | A | * | 9/1922 | Palmer | 108/115 |
| 2,122,969 | A | * | 7/1938 | Whitcomb | 108/9 |
| 2,229,320 | A | * | 1/1941 | Balzano et al. | 108/75 |
| 2,275,060 | A | * | 3/1942 | Griffin | 312/334.27 |
| 2,758,898 | A | | 8/1956 | Kobsch | |
| 2,907,616 | A | | 10/1959 | Sullivan | |
| 3,401,650 | A | * | 9/1968 | Terezas | 108/25 |
| 3,609,892 | A | * | 10/1971 | Caire | 38/18 |
| 4,066,023 | A | | 1/1978 | Hughes | |
| D276,955 | S | | 1/1985 | Hanemaayer | |
| 4,635,894 | A | * | 1/1987 | Sammons | 248/558 |
| 4,646,654 | A | | 3/1987 | Sullivan | |
| 5,329,712 | A | * | 7/1994 | Keller | 40/747 |
| D386,022 | S | | 11/1997 | Bennett | |
| D393,969 | S | | 5/1998 | Jenkins et al. | |
| 5,996,666 | A | * | 12/1999 | Denina | 160/62 |
| 6,161,486 | A | * | 12/2000 | Boots | 108/48 |
| D520,267 | S | * | 5/2006 | Berger et al. | D6/474 |
| 7,628,439 | B1 | * | 12/2009 | Strong | 296/26.03 |
| 2002/0059887 | A1 | * | 5/2002 | Marshall et al. | 108/39 |

* cited by examiner

*Primary Examiner* — Janet M Wilkens

(57) ABSTRACT

An expandable table that is utilized as a kitchen table, with the table having several leafs that extend outward from underneath the primary surface of the table and serve to greatly increase the surface area of the table. Ideally, the table has a square or rectangular shape, allowing the mounting of four separate leafs that can be pulled out of each side of the table. Each leaf can be pulled out almost its full length and then be supported by an attached, hinged leg that provides extra support to the leaf after it has been pulled out from underneath the primary surface of the kitchen table.

5 Claims, 4 Drawing Sheets

EXPANDABLE TABLE

BACKGROUND OF THE INVENTION

The present invention concerns that of a new and improved expandable table that is preferably utilized as a kitchen table, with the table having several leafs that extend outward from underneath the primary surface and greatly increase the surface area of the table.

SUMMARY OF THE INVENTION

The present invention concerns that of a new and improved expandable table that is preferably utilized as a kitchen table, with the table having several leafs that extend outward from underneath the primary surface of the table and serve to greatly increase the surface area of the table. Ideally, the table has a square or rectangular shape, allowing the mounting of four separate leafs that can be pulled out of each side of the table. Each leaf can be pulled out almost its full length and then be supported by an attached, hinged leg that provides extra support to the leaf after it has been pulled out from underneath the primary surface of the kitchen table.

There has thus been outlined, rather broadly, the more important features of an expandable table that the detailed description thereof that follows may be better understood and in order that the present contribution to the art may be better appreciated. There are, of course, additional features of the expandable table that will be described hereinafter and which will form the subject matter of the claims appended hereto.

In this respect, before explaining at least one embodiment of the expandable table in detail, it is to be understood that the expandable table is not limited in its application to the details of construction and to the arrangements of the components set forth in the following description or illustrated in the drawings. The expandable table is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present expandable table. It is important, therefore, that the claims be regarded as including such equivalent constructions insofar as they do not depart from the spirit and scope of the present invention.

It is therefore an object of the present invention to provide an expandable table which has all of the advantages of the prior art and none of the disadvantages.

It is another object of the present invention to provide an expandable table which may be easily and efficiently manufactured and marketed.

It is another object of the present invention to provide an expandable table which is of durable and reliable construction.

It is yet another object of the present invention to provide an expandable table which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
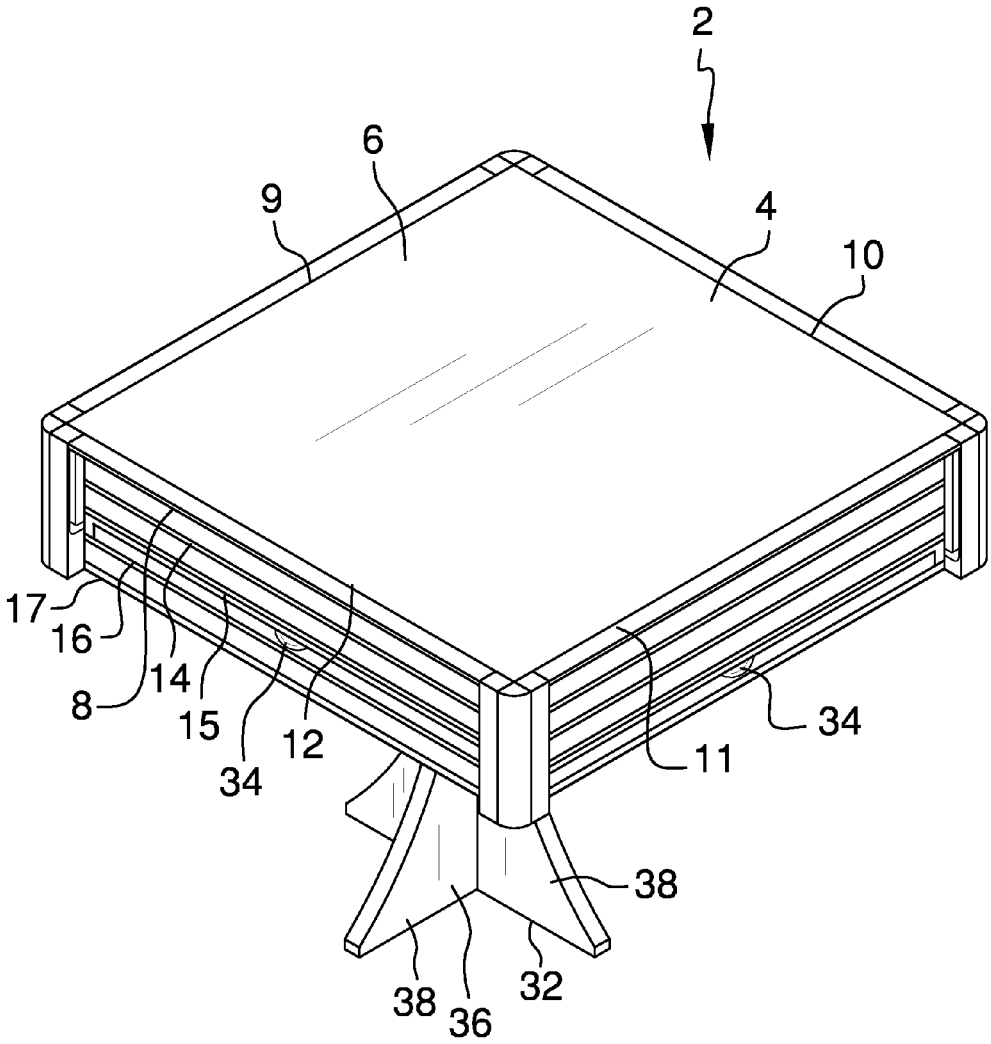
FIG. 1 shows an upper perspective view of the expandable table in a closed position.
Figure 2:
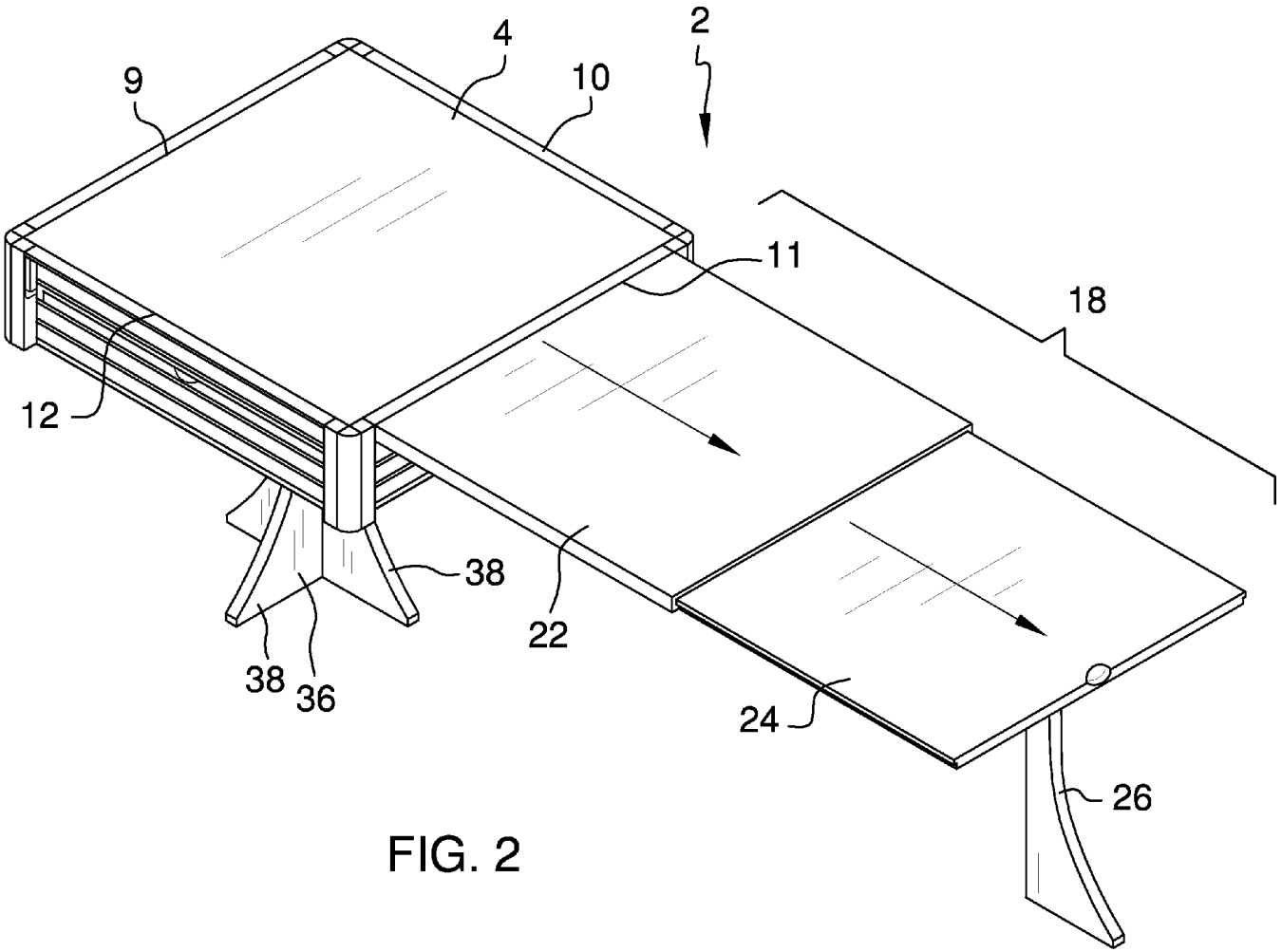
FIG. 2 shows an upper perspective view of the expandable table as it shows one of the leaves having been expanded outward.
Figure 3:
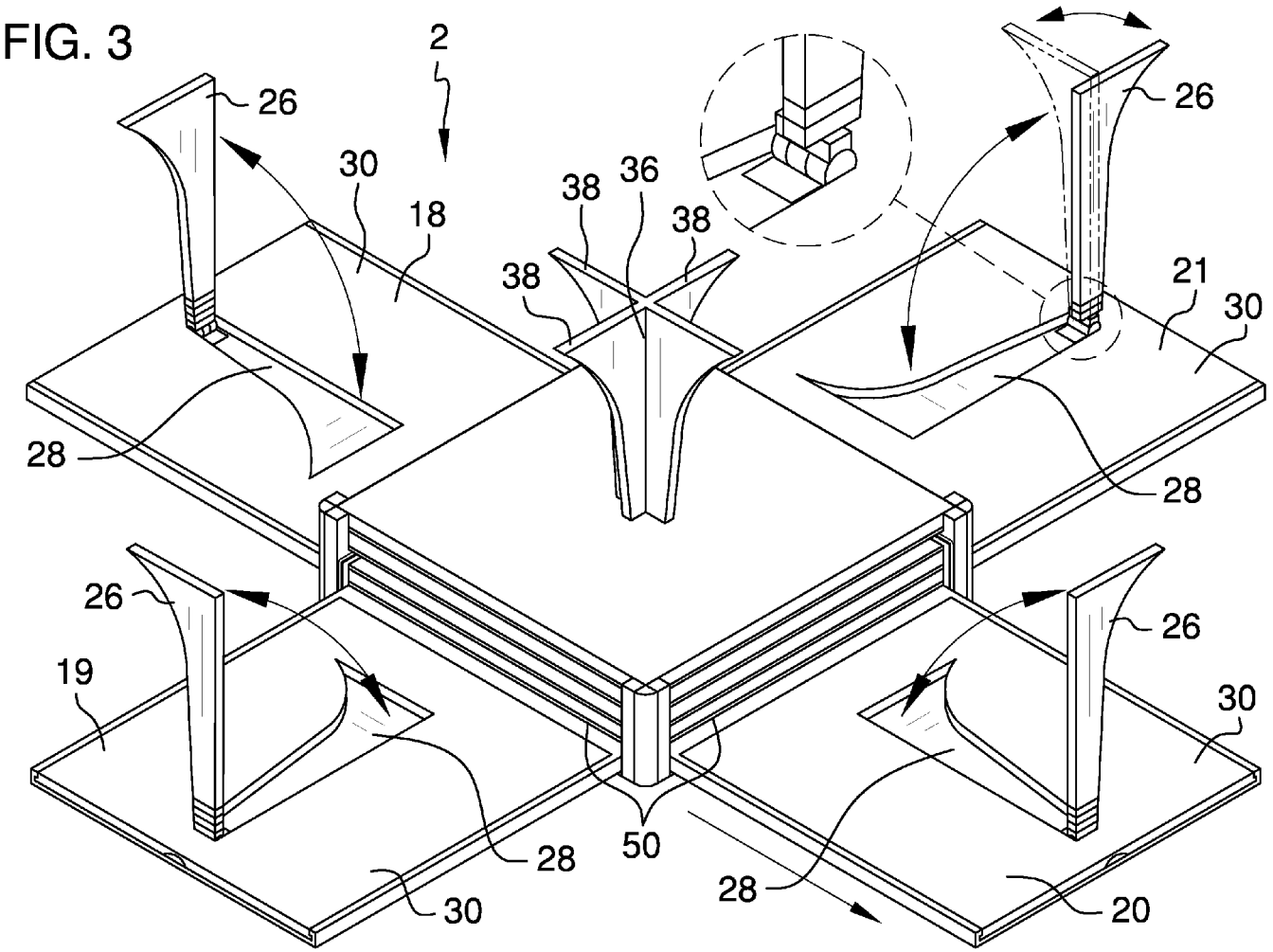
FIG. 3 shows an upper perspective view of the expandable table as it shows all of the leaves having been expanded outward and the attachable legs having been expanded outward.
Figure 4:
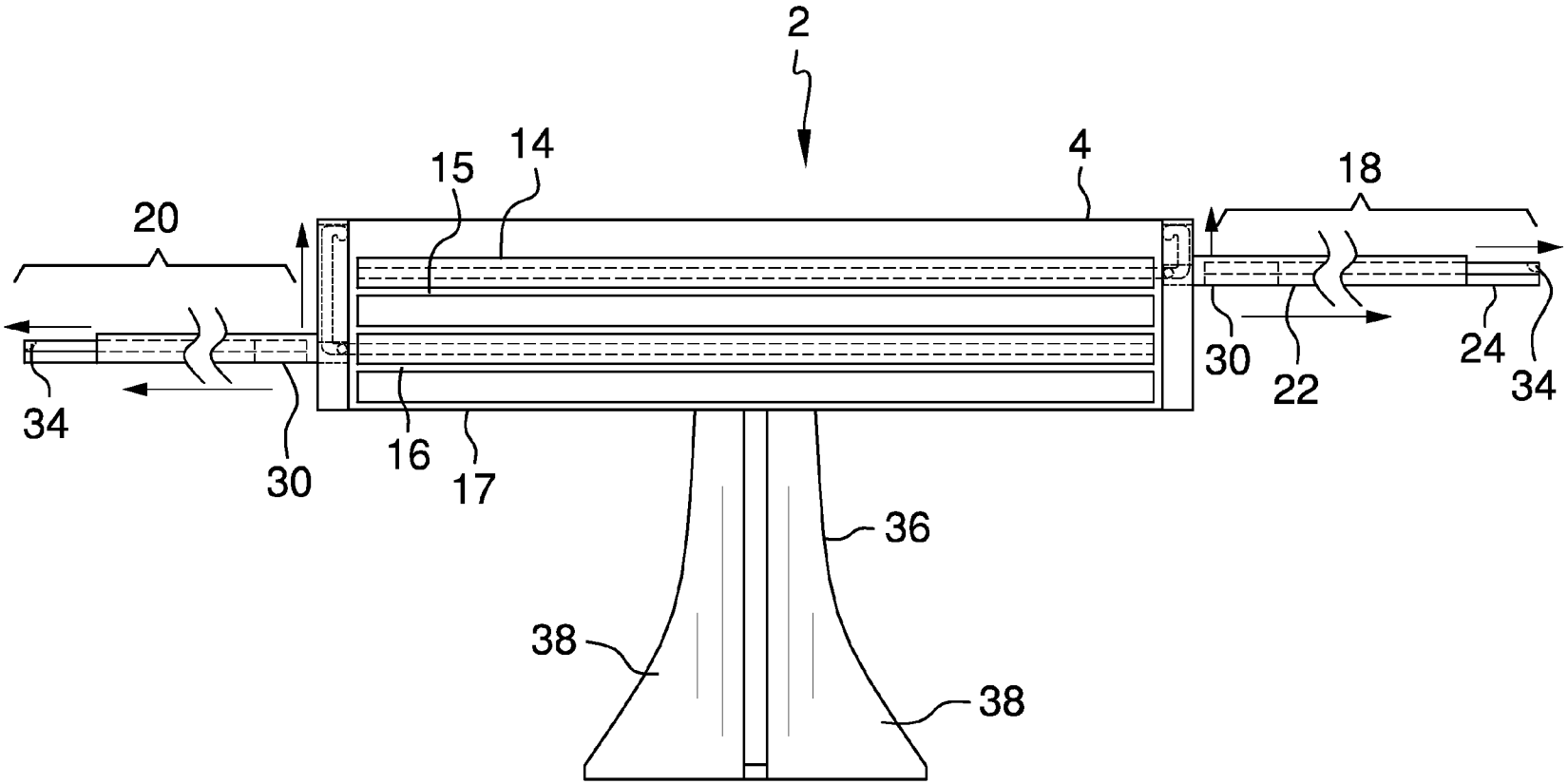
FIG. 4 shows a side cutaway view of the expandable table in a closed position.

With reference now to the drawings, and in particular to FIGS. 1 through 4 thereof, an expandable table embodying the principles and concepts of the present invention and generally designated by the reference numeral 2 will be described.

As best illustrated in FIGS. 1 through 6, the expandable table 2 comprises a primary surface 4, with the primary surface 4 having an upper surface 6 and a lower surface 8. The primary surface 4 ideally has a square or rectangular shape, giving the primary surface 4 of the table 2 four sides 9-12.

The table 2 has a quartet of casings 14-17 that are located underneath the lower surface 8 of the primary surface 4. Each casing 14-17 houses a leaf 18-21, with each leaf capable of being extended out of its appropriate casing out of a different side. Each casing 14-17 has an opening 50.

Furthermore, each leaf has an upper support component 22 and a lower support component 24. The lower support component 24 is slidably inserted into the upper support component 22, which in turn, is the first item of the leaf pulled out of respective casing when an individual desires to use the leaf. When using a particular leaf, an individual has the choice of utilizing the leaf with the lower support component 24 still inserted within the upper support component 22, or in the alternative, has the option of extending the lower support component 24 out of the upper support component 22.

Each lower support component 24 of each leaf of the table 2 has a support leg 26 that is pivotally attached to the lower support component 24 and allows each particular leaf pulled out to be supported in a horizontal position. The support leg 26, when not in use, normally rests within an insert 28 that is located on the lower surface 30 of each lower support component 24. The support leg 26 of an extended leaf can be pulled out of the insert 28 and placed against a ground surface 32 irregardless of whether the lower support component 24 is further pulled out of the upper support component 22 or whether the lower support component 24 is further pulled out of the upper support component 22 remains within the upper support component 22 when the leaf is extended for use.

To further aid an individual in pulling out individuals leaves of the table 2 as needed, each lower support component 24 of each leaf 18-21 has a handle 34 attached to it, providing assistance to an individual when pulling out each leaf as needed.

To help support the primary surface 4, a central table leg 36 is mounted underneath the table to the lowest casing 17. The table leg 36 supports the entire expandable table 2 off of the ground surface and has a plurality of flanges 38 to provide additional support for the table 2.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. An expandable table comprising a primary surface, the primary surface having two surfaces comprising an upper surface and a lower surface, a plurality of table leaves, means for attaching each of the table leaves of the plurality of table leaves to the primary surface, means for supporting the expandable table on a ground surface, wherein the primary surface has a square or rectangular shape, wherein the primary surface of the expandable table has four sides comprising a first side, a second side, a third side, and a fourth side, wherein the means for attaching each of the table leaves of the plurality of table leaves to the primary surface further comprises a quartet of casings, the quartet of casings comprising a first casing, a second casing, a third casing, and a fourth casing, wherein each of the casings are attached to the expandable table underneath the lower surface of the primary surface, each casing having an opening, the table leaves comprising a quartet of leaves, the quartet of leaves comprising a first leaf, a second leaf, a third leaf, and a fourth leaf, wherein each of the leaves is inserted into one casing, and means for supporting each leaf in a horizontal position once said leaf is pulled out of its casing, wherein each leaf further comprises an upper support component, a lower support component, wherein the lower support component is slidably inserted into the upper support component, wherein the upper support component is the first item pulled out of its respective casing when one of the table leaves is utilized, wherein the table further comprises means for pulling each leaf out of its respective casing, said means further comprising a plurality of handles, and wherein one of the is attached to each lower support component.

2. An expandable table according to claim 1 wherein the means for supporting each leaf in a horizontal position once said leaf is pulled out of its casing further comprises (a) a plurality of support legs, (b) wherein one of the support legs is pivotally attached to the lower surface of the lower support component of each leaf, (c) wherein the support leg of the lower support component attached to one of the leaves that has been extended out of one of the casings can be extended as needed.

3. An expandable table according to claim 2 wherein the means for supporting the expandable table on a ground surface further comprises (a) a central table leg, wherein the central table leg is attached to the lowest casing of the plurality of casings, and (b) means for providing additional support to the central table leg.

4. An expandable table according to claim 3 wherein the means for providing additional support to the central table leg further comprises (a) a plurality of flanges, (b) wherein each of the flanges of the plurality of flanges are attached to the central table leg.

5. An expandable table comprising (a) a primary surface, the primary surface having two surfaces comprising an upper surface and a lower surface, the primary surface having a square or rectangular shape, the primary surface having four sides comprising a first side, a second side, a third side, and a fourth side, (b) a plurality of table leaves, (c) means for attaching each of the table leaves of the plurality of table leaves to the primary surface, said means further comprising (i) a quartet of casings, the quartet of casings comprising a first casing, a second casing, a third casing, and a fourth casing, wherein each of the casings are attached to the expandable table underneath the lower surface of the primary surface, each casing having an opening, (ii) the table leaves comprising a quartet of leaves, the quartet of leaves comprising a first leaf, a second leaf, a third leaf, and a fourth leaf, wherein each of the leaves is inserted into one of the casings, wherein each leaf further comprises (1) an upper support component, (2) a lower support component, wherein the lower support component is slidably inserted into the upper support component, (3) wherein the upper support component is the first item pulled out of its respective casing when a leaf is utilized, and (iii) means for supporting each leaf in a horizontal position once said leaf is pulled out of its casing, said means further comprising (1) a plurality of support legs, (2) wherein one of the support legs is pivotally attached to the lower surface of the lower support component of each of the leaves, (3) wherein the support leg of the lower support component attached to one of the leaves that has been extended out of one of the casings can be extended as needed, and (d) means for pulling each leaf out of its respective casing, said means further comprising, said means further comprising (i) a plurality of handles, (ii) wherein one of the handles is attached to each lower support component, (e) means for supporting the expandable table on a ground surface, said means further comprising (i) a central table leg, wherein the central table leg is attached to the lowest casing of the plurality of casings, (ii) means for providing additional support to the central table leg, said means further comprising (1) a plurality of flanges, (2) wherein each of the flanges of the plurality of flanges are attached to the central table leg.

* * * * *